United States Patent [19]

Miller, deceased et al.

[11] 4,371,026

[45] Feb. 1, 1983

[54] AIR CONDITIONER SUPPORTED CURTAIN HOLDER

[76] Inventors: Pauline K. Miller, deceased, late of Baltimore, Md.; by Norman Miller, legatee, 520 Cedar Hill Rd., Baltimore, Md. 21225

[21] Appl. No.: 167,153

[22] Filed: Jul. 8, 1980

[51] Int. Cl.[3] ..... A47H 1/18

[52] U.S. Cl. ..... 160/349 D; 160/DIG. 16

[58] Field of Search ..... 160/349 D, 349 R, DIG. 16; 98/94 AC, 99 A, 44; 62/262, 263; 248/217.1, 208, 206 A

[56] References Cited

U.S. PATENT DOCUMENTS

| | | | |
|---|---|---|---|
| 1,666,408 | 4/1928 | Dalton | 160/349 D |
| 1,954,419 | 4/1934 | Lynch et al. | 160/349 D X |
| 2,595,887 | 5/1952 | Ringler | 160/349 D X |

*Primary Examiner*—Rodney H. Bonck

*Attorney, Agent, or Firm*—Marvin S. Towsend

[57] ABSTRACT

A group of curtain holding panels are attached to and supported by a window air conditioner unit for keeping window drapes or curtains out of the path of air flow of the air conditioner. The curtain holding panels attach to the side and top surfaces of the air conditioner by magnets, contact adhesive, or a clamp.

8 Claims, 2 Drawing Figures

AIR CONDITIONER SUPPORTED CURTAIN HOLDER

FIELD OF THE INVENTION

The invention is in the area of holders for window curtains particularly for keeping them from interfering with the air flow from window air conditioner units.

BACKGROUND OF THE INVENTION

When a window air conditioner is installed in a window, it is desirable to keep curtains or drapes out of the way of the air flow from the air conditioner.

More generally, when curtains or drapes are hung over the entire front of a window, it is often desirable to hold the curtains or drapes away from the front of the window, especially the lower front, in order that air flow through the open window should not be impeded by the curtains or drapes. In addition, it is desirable to hold the drapes out of the path of air flow so that the drapes themselves are not disturbed or damaged by the air flow through the window.

The prior art of curtain holders shows three types of devices for holding curtains out of the way of the air flow through the lower front of a window. One type of device attaches directly onto the curtain and drape. This type of curtain holder is supported by the curtain itself. It must clamp onto the drape, and its weight constantly pulls on the drape and the drape support rod adding stress to both the drape and drape support rod that neither was designed to withstand. A device of this kind is disclosed in U.S. Pat. No. 2,595,887.

Another type of curtain holding device is attached to the stationary window frame. Screws or nails must be installed within the window frame structure thereby damaging a smooth surface finish such as a painted surface. Devices of this kind are disclosed in U.S. Pat. Nos. 1,722,899; 3,420,289; and 4,058,873.

A third type of curtain holding device attaches to a movable portion of the window itself. Screw, nails, or clamps must be installed on the movable window structure thereby damaging a smooth surface finish. Devices of this type are disclosed in U.S. Pat. Nos. 1,697,978 and 1,954,419.

No prior art patents disclose a curtain holder specifically designed to keep curtains out of the air flow from a window air conditioner unit.

In view of the problems cited above, it is an object of the invention to provide a curtain holder which does not add stress upon the drape or the drape rod support.

Another object of the invention is to provide a curtain holder whose installation does not require damaging the surface finish of the stationary window frame.

Another object of the invention is to provide a curtain holder whose installation does not require damaging the surface finish of the movable window structure.

Another object of the invention is to provide a curtain holder specifically designed to keep the curtain or drape out of the air flow from a window air conditioner unit.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects and in accordance with the purpose of the present invention, as embodied and broadly described herein, the air conditioner supported curtain holder of the invention may comprise a group of curtain holding panels attachable to the top and side surfaces of a window air conditioner unit.

Preferably, the panels are attached to the air conditioner unit by magnets. Other attaching means may be employed such as contact adhesive or a clamp.

Preferably, the curtain holding panels have two planar portions perpendicular to one another. The front planar portion has the attaching means and is placed into contact with either the side or top of the air conditioner. The second planar portion, perpendicular to the first planar portion, presses against the curtain and keeps it out of the path of the air flow of the air conditioner unit. The top and side panels may have portions which overlap to add stability to the curtain holder and provide a pleasing appearance.

In accordance with the invention, there may be two top panels which are slidingly engaged with one another (with a tongue in groove) so that they are adjustable to fit the air conditioner.

In addition, in accordance with the invention, two top panels may be connected by a clip interposed between and engaging both top panels.

The following benefits and advantages are derived from employment of the air conditioner supported curtain holder of the invention. A curtain holder specifically designed to keep curtains and drapes out of the path of air flow of a window air conditioner unit is provided. No weight of the curtain holder is supported by the curtain itself or the curtain rod support. The smooth surface finish of the stationary window frame and the movable window are not damaged by installation of the curtain holder of the invention. Two top panels are adjustable with respect to one another so they can be adjusted to fit the air conditioner.

BRIEF DESCRIPTION OF THE DRAWINGS

The accompanying drawings, which are incorporated in and form a part of the specification, illustrate a preferred embodiment of the present invention and, together with the description, serve to explain the principles of the invention. In the drawings.

DETAILED DESCRIPTION OF THE INVENTION

Figure 1:
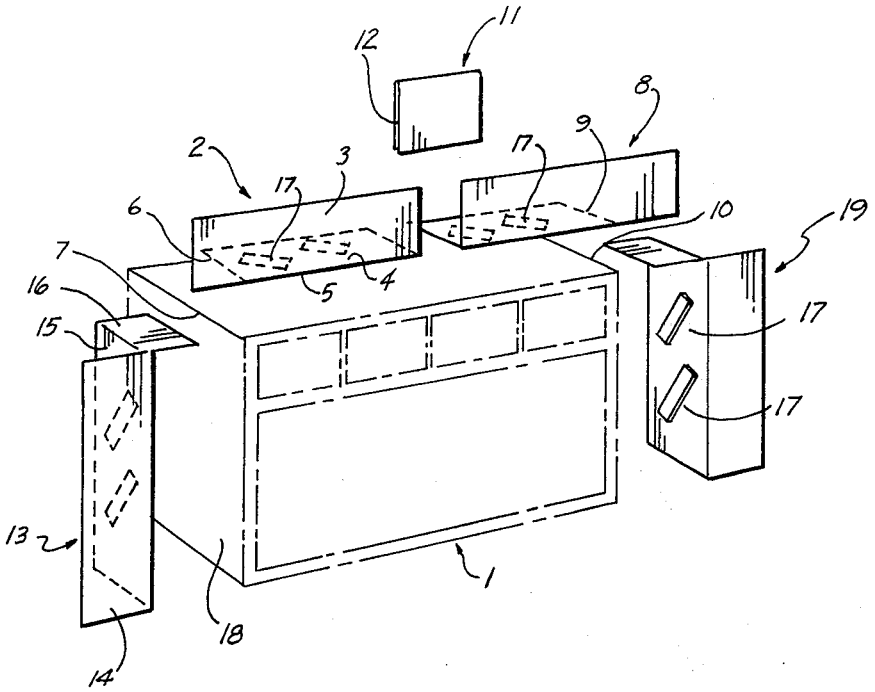
FIG. 1 is an exploded perspective view of one embodiment of the invention.

Reference will now be made in detail to the embodiment of the invention illustrated in the drawings.

In FIG. 1, window air conditioner unit 1 serves as support for curtain holding panels of the invention. Curtain holding panels of the invention include: side panels 13 and 19; first top panel 2; and second top panel 8. The curtain holding panels 13, 19, 2, and 8 are attached to the window air conditioner unit 1, having top surface 10 and side surface 18, by means of magnets 17. Clip 11, having slot 12, is placed over the inner edges of the first and second top panels 2 and 8 after they are adjusted to fit the air conditioner 1. Clip 11 is preferably resilient and serves to clamp onto both top panels 2 and 8.

Top panels 2 and 8 both have first and second portions which are perpendicular to one another. With regard to first top panel 2 in particular, first planar portion 4, to which magnets 17 are attached, is perpendicular, at line 5, to second planar portion 3 which serves to hold the drapes or curtains 20 (as shown in FIG. 2) out of the path of air flow of the air conditioner 1.

Side panels 13 and 19 also have first and second perpendicular portions. With regard to side panel 13 in particular, first planar portion 15, to which magnets 17 are attached, is perpendicular to second planar portion 14 which serves to hold the drapes or curtains 20 (as shown in FIG. 2) out of the air flow from air conditioner 1.

First planar portion 4 of first top panel 2 is shown to have outside edge 6 which is adjusted to line up with corner 7 of air conditioner 1. Side panel 13 is shown to have inwardly projecting portion 16 which fits over edge 6 of first top panel 2 when side panel 13 is attached to side surface 18 of the air conditioner 1. A similar inwardly projecting portion is provided on side panel 19 which fits over edge 9 of second top panel 8.

Figure 2:
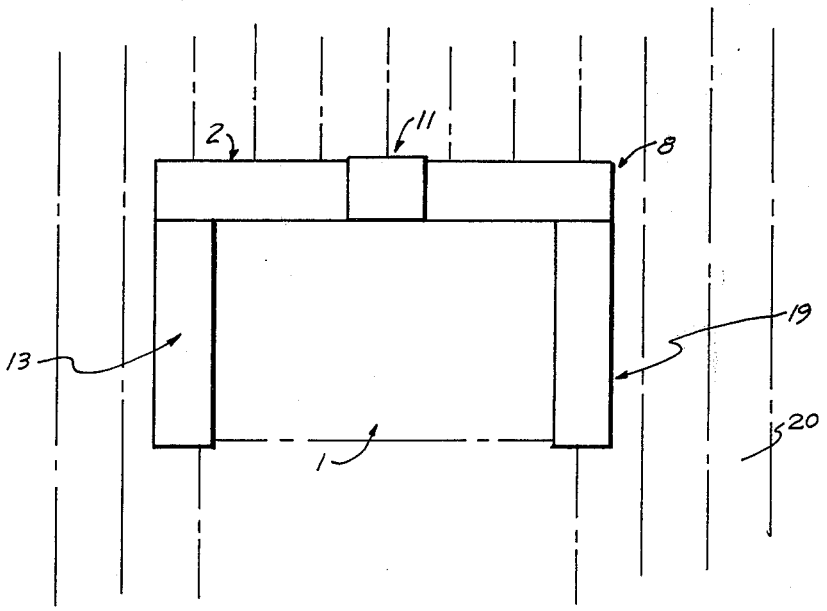
FIG. 2 is a front view of a curtain holder of the invention in use on an air conditioner.

FIG. 2 shows air conditioner 1 supporting side panels 13 and 19 and top panels 2 and 8, connected by clamping clip 11, which are holding back drape or curtain 20.

Various alternative embodiments of the panel means of the invention are possible. For example, instead of the five piece curtain holder construction as shown in FIG. 1, a three piece construction is possible. For a three piece construction, a left side panel and a left top panel are unified into a single left top/side panel. Similarly, the right top and right side panels are unified into a single right top/side panel. The two panels are then connected by a clamping clip.

A two piece curtain holder construction is also possible. In this case, a unified right top/side panel and a unified left top/side panel are used. The top portions of each panel overlap and are slidably connected with a tongue in groove means.

Alternative means for adhering curtain holding panels to the support surfaces of the air conditioner include a contact adhesive.

In view of the foregoing the following benefits and advantages are derived from employment of the air conditioner supported curtain holder of the invention. A curtain holder specifically designed to keep curtains and drapes out of the path of air flow of a window air conditioner unit is provided. No weight of the curtain holder is supported by the curtain itself or the curtain rod support. The smooth surface finish of the window structures are not damaged by installation of the holder of the invention. Two top panels are adjustable with respect to one another so they can be adjusted to fit the air conditioner. The curtain holding panels of the invention and their associated clamping means may be in the form of either a two-piece, three-piece, or five-piece construction.

While there have been shown and described preferred forms of the invention, it is to be understood that the invention is not necessarily confined thereto, and that there are changes in the structure of and in the relative arrangement of components thereof that are contemplated as being within the scope of the invention as defined in the claims.

What is claimed is:

1. A curtain holder, comprising:

a. panel means for holding curtains or drapes out of the path of air flow of a window air conditioner unit, wherein said panel means are comprised of top panel means disposed adjacent to the top of the air conditioner unit and side panel means disposed adjacent to the sides of the air conditioner unit, and wherein said top and side panel means have two planar portions, a first planar portion to which air conditioner attaching means are attached, and a second planar portion perpendicular to said first planar portion which holds the curtains or drapes out of the path of air flow of the window air conditioner unit;

b. a means for attaching said panel means to the window air conditioner unit.

2. A curtain holder as described in claim 1 wherein said panel attaching means are magnets.

3. A curtain holder as described in claim 1 wherein said panel attaching means is a contact adhesive.

4. A curtain holder, comprising:

a. panel means for holding curtains or drapes out of the path of air flow of a window air conditioner unit; and b. means for attaching said panel means to the window air conditioner unit;

wherein said panel means include a first top panel means and a second top panel means for adjusting said panel means to fit the window air conditioner unit.

5. A curtain holder as described in claim 4 further including a clip means for connecting said first and second top panel means.

6. A curtain holder as described in claim 4 wherein said first top panel means and said second top panel means are slidingly engaged with one another so that said first and second top panel means are adjustable to fit window air conditioner unit.

7. A curtain holder as described in claim 6 wherein said first and second top panel means are slidingly engaged with one another by tongue in groove means.

8. A curtain holder, comprising:

a. panel means for holding curtains or drapes out of the air flow path of a window air conditioner unit, wherein said panel means include a top panel and a side panel for attaching to the top and side, respectively of the window air conditioner unit; and b. means for attaching said panel means to the window air conditioner unit.

* * * * *